US005942132A

United States Patent [19]

Toyooka et al.

[11] Patent Number: 5,942,132

[45] Date of Patent: Aug. 24, 1999

[54] METHOD OF AND APPARATUS FOR PRODUCING STEEL PIPES

[75] Inventors: Takaaki Toyooka; Motoaki Itadani; Akira Yorifuji; Yuji Hashimoto; Toshio Ohnishi; Nobuki Tanaka; Yoshinori Sugie; Koji Sugano, all of Aichi; Toshiaki Amagasa, Chiba, all of Japan

[73] Assignee: Kawasaki Steel Corporation, Japan

[21] Appl. No.: 08/872,427

[22] Filed: Jun. 10, 1997

[51] Int. Cl.[6] ..... B23K 13/01

[52] U.S. Cl. ..... 219/61.2

[58] Field of Search ..... 219/61.2, 61, 61.11, 219/61.12, 61.13, 61.3, 61.5

[56] References Cited

U.S. PATENT DOCUMENTS

| | | | |
|---|---|---|---|
| 3,015,018 | 12/1961 | Rudd | 219/61.2 |
| 3,523,513 | 8/1970 | Maier et al. | 219/61.2 |
| 3,539,760 | 11/1970 | Rudd | 219/61 |
| 3,539,761 | 11/1970 | Rudd | 219/61 |
| 3,729,124 | 4/1973 | Kedzior et al. | 219/61 |
| 3,944,775 | 3/1976 | Worden | 219/61.13 |
| 4,223,196 | 9/1980 | Erlandson et al. | 219/61.2 |
| 4,830,258 | 5/1989 | Lentz et al. | 219/61.1 |
| 5,140,123 | 8/1992 | Mitani | 219/61.2 |
| 5,567,335 | 10/1996 | Baessler et al. | 219/61.2 |

FOREIGN PATENT DOCUMENTS

| | | |
|---|---|---|
| 60-015082 | 1/1985 | Japan . |
| 2-299782 | 12/1990 | Japan . |
| 5-228650 | 9/1993 | Japan . |
| WO 82/01835 | 6/1982 | WIPO . |
| WO 96/03249 | 2/1996 | WIPO . |

*Primary Examiner*—Clifford C. Shaw
*Attorney, Agent, or Firm*—Austin R. Miller

[57] ABSTRACT

A method of producing steel pipes is provided which comprises the steps of providing a steel strip, processing the steel strip into a preheated open pipe, preheating the open pipe at its two opposite longitudinal edges at a temperature higher than about the Curie point, heating the open pipe at the two opposite edges at a temperature higher than about 1,300° C. but lower than the melting point of the steel strip, pressure welding the resultant open pipe with a squeeze roll to thereby form a steel pipe, smoothing the steel pipe at its thick-walled portion formed on an outer surface of the welded seam, and subsequently cutting or winding the resulting steel pipe. An apparatus adapted to form the steel pipes is also provided.

38 Claims, 9 Drawing Sheets

METHOD OF AND APPARATUS FOR PRODUCING STEEL PIPES

BACKGROUND OF THE INVENTION

1. Field of the Invention

The present invention relates to a novel method of and a novel apparatus for the production of steel pipes which are capable of making a steel pipe of excellent weld seaming and surface texture qualities with high productivity and which are adaptable to produce a wide variety of small product lots.

2. Description of the Related Art

Welded steel pipes are produced by subjecting a steel plate or a steel strip to cylindrical shaping and then to seam welding. Such steel pipe products of from small to large diameters have been produced by various methods among which electric resistance welding, forge welding or electric arc welding are typified.

In the production of steel pipes having small and medium diameters, electric resistance welding method has become predominant. This welding method is devised to cylindrically form a steel strip by a forming roll into an open pipe which is then heated at its two opposite lengthwise end faces by means of high-frequency induction heating at a temperature above the melting point of the steel strip. Those opposed end faces of the open pipe are subsequently butt-welded by a squeeze roll, whereby a steel pipe is obtained.

When an electric resistance weld pipe is produced by the above method of high-frequency induction heating, the open pipe is heated at its two opposite longitudinal end faces at a temperature higher than the melting point of the starting steel strip. Molten steel flows under the electromagnetic force, making a resulting oxide that gets into the butt-welded seam. This has a tendency to cause weld defects or molten steel splashes.

In order to overcome those problems, a method of producing an electric resistance weld pipe has been proposed in Japanese Unexamined Patent Publication No. 2-299782. Two different heaters are employed. A first heater is intended to heat two opposed edges of an open pipe at a temperature higher than the Curie point, and the second heater heats those opposed edges additionally to a temperature higher than the melting point of the starting steel strip and thereafter the open pipe edges are butt-welded by a squeeze roll. Japanese Unexamined Patent Publication No. 2-299783 also proposes a method of producing an electric resistance weld pipe employing two different heaters. Two opposite longitudinal edges of an open pipe are preheated with a current of a 45 to 250 kHz frequency applied in a first heater, and the open pipe edges are further heated at a temperature higher than the melting point of the starting steel strip in a second heater and thereafter butt-welded by a squeeze roll.

The foregoing methods of producing electric resistance weld pipes teach heating two opposite edge portions of an open pipe in uniform manner, but suffer from beads arising from flow of molten steel onto inner and outer surfaces of the pipe during butt welding since the open pipe edges are heated at a temperature higher than the melting point of the starting steel strip. The beads must be removed after butt welding. This removal is conducted laboriously by use of a bead-cutting tool.

However, such prior art methods encounter serious problems.

(1) The bead-cutting tool needs to be adjusted depending upon the amount of beads to be cut, with eventual losses of material and time.

(2) Due to its single-use character, the bead-cutting tool requires replacement, which entails costly shutdown of the associated production line.

(3) Especially in the case of steel pipe production at a high speed exceeding 100 m/min, the bead-cutting tool causes shortened life, ultimately involving frequent replacement.

Consequently, bead cutting imposes a bottleneck on production of steel pipes and prevents higher productivity.

Those production methods have another serious problem in that they fail to cope with production of small lots in a variety of steel pipe products. Such methods should choose those rolls meeting with the users' dimensional requirements, or otherwise should provide for an enormously increasing number of rolls of varied sizes.

With the above problems in view, it has been proposed to stretch reduce-roll an electric resistance weld pipe in a cold state, as described in Japanese Unexamined Patent Publication Nos. 63-33105 and 2-187214. Such stretch reduce rolling in a cold condition, however, invites a sharp rise in rolling load with eventual need for scaling up of a mill. It also requires a lubrication rolling unit to prevent seizing of the steel pipe which would result from contact of the latter with a roll. This results in added equipment cost and increased floor space in an uneconomical way.

In Japanese Unexamined Patent Publication No. 60-15082 and Japanese Examined Patent Publication No. 2-24606, there are taught methods in which an electric resistance weld pipe is stretch reduce-rolled in a hot condition. These methods have the drawback that because of exposure to reheating at from 800 to 900° C. or higher, the steel pipe suffers from adverse scaling or scale biting during stretch reduce-rolling.

On the other hand, a highly productive method of making a forge-welded steel pipe is known to be suited for the formation of a steel pipe of a relatively small diameter. In this method, a continuously supplied steel strip is heated at about 1,300° C. in a furnace and then shaped cylindrically by a forming roll to form an open pipe. High-pressure air is thereafter blown onto two opposed edge faces of the open pipe so as to remove scales, followed by blowing of oxygen onto the edge faces using a welding horn and by subsequent heating of the thus treated edge faces with the resultant oxidized heat at about 1,400° C. Thereafter, these edge faces are butted by a forging roll and welded together at a solid phase, whereby a steel pipe is obtained.

The method discussed above, however, is deficient in the following respects.

(1) Because of failure of the open pipe to sufficiently remove scales at the edge faces, the scales bite into the forge-welded joint. This renders the welded joint inferior in strength to the mating matrix portion. Flattening tests have shown that the forged-welded steel pipe is extremely small in respect of its flat height ratio, say as low as h/D=0.5, as against the ratio or h/D=2t/D (t: steel strip thickness) attainable in the case of the electric resistance weld pipe.

(2) On account of exposure of the open pipe to heating at elevated temperature, scaling takes place on the pipe surface, bringing about a marred surface texture.

Despite its high efficiency with a pipe rolling speed of 300 m/min or above, the method in question leads to insufficient weld seaming and texture properties, eventually failing to produce a steel pipe having the strength and surface requirements satisfied as stipulated by STK and other provisions of JIS (Japanese Industrial Standards).

SUMMARY OF THE INVENTION

In order to eliminate the aforementioned problems of the prior art, the present invention has for an important object to provide a new method of and a new apparatus for the production of steel pipes which enable a steel pipe to be formed with excellent weld seaming and surface texture qualities and with high production efficiency and which offers good adaptation to a large variety of small product lots.

According to one aspect of the present invention, there is provided a method of production of steel pipes which comprises the steps of:

(a) paying off a steel strip out of an uncoiler;

(b) forming the steel strip into a preheated open pipe by one of the following three process steps;

(1) the steel strip is preheated and then formed into an open pipe with a forming roll;

(2) the steel strip is formed with a forming roll to provide an open pipe, followed by preheating of the open pipe in its entirety; and (3) the steel strip is preheated and then formed with a forming roll to provide an open pipe, followed by preheating of the open pipe in its entirety; and (c) preheating the open pipe at its two opposite longitudinal edges by induction heating at a temperature higher than about the Curie point;

(d) heating the open pipe at the opposite edges by induction heating at a temperature higher than about 1,300° C. but lower than the melting point of the steel strip, and pressure-welding the resultant open pipe with a squeeze roll to thereby form a steel pipe;

(e) smoothing the steel pipe at a thick-walled portion formed on an outer surface of the welded seam; and (f) subsequently cutting the resulting steel pipe to length, or winding the same into coiled form.

According to another aspect of the invention, there is provided a method of the production of steel pipes which comprises the steps of:

(a) paying off a steel strip out of an uncoiler;

(b) forming the steel strip into a preheated open pipe by one of the following three process steps;

(1) the steel strip is preheated and then formed using a forming roll;

(2) the steel strip is formed with use of a forming roll to provide an open pipe, followed by preheating the open pipe in its entirety; and (3) the steel strip is preheated and then formed with a forming roll to provide an open pipe, followed by preheating the open pipe in its entirety; and (c) preheating the open pipe at its two opposite longitudinal edges by induction heating at a temperature higher than about the Curie point;

(d) heating the open pipe at its opposite edges by induction heating at a temperature higher than about 1,300° C. but lower than the melting point of the steel strip, and causing the resultant open pipe to pressure-weld with a squeeze roll to form a steel pipe;

(e) smoothing the steel pipe at its thick-walled portion formed on an outer surface of the welded seam;

(f) cooling the steel pipe forcedly at the welded seam;

(g) heating the steel pipe wholly circumferentially at a uniform temperature;

(h) stretch reduce-rolling the steel pipe at a temperature of about 125 to 725° C.; and (i) subsequently cutting the resulting steel pipe to length, or winding the same into coiled form.

Other objects, features and advantages of the present invention will be apparent from the following description taken in conjunction with the accompanying drawings.

DESCRIPTION OF THE PREFERRED EMBODIMENTS

This invention will now be described with reference to particular embodiments selected for illustration in the Figures. It will be understood that the invention is not limited to the illustrated and described embodiments, and that the invention is defined separately in the appended claims.

To produce a welded steel pipe according to the method of the present invention, a steel strip is first paid off of an uncoiler and subjected to preheating.

In this instance, the steel strip so taken out may be connected to a rear end of a preceding steel strip and to a front end of an ensuing steel strip so as to provide an elongate steel strip which is thereafter preheated. The reason behind this preheating is that the temperature difference should be reduced between two lengthwise edge portions of an open pipe and a matrix portion contiguous with and adjacent to those edge portions when the latter are heated at a later stage. Thus, an adequate range of temperatures and of temperature distributions can be easily maintained in such a temperature region so as to undergo solid-phase pressure-welding.

Either one of a heating method using a heating furnace, a heating method using an induction coil, and a resistance heating method using a current flow is suitably applicable as preheating means for the practice of the present invention.

The steel strip should be preheated to a temperature from about 200 to about 750° C. Temperatures higher than 750° C. can be responsible for generating increased scales on surfaces of the steel strip and hence for impaired qualities of both weld seaming and surface texture of the finished steel pipe. At temperatures lower than 200° C., heat diffuses from the open pipe edges to the mating matrix to a great extent during heating of the edges, thus making it difficult to retain suitable temperatures and temperature distributions in a solid-phase pressure-welding temperature region. Thus, preheating temperatures most desirably range from about 400 to 650° C.

The steel strip thus preheated is continuously formed into an open pipe by use of a plurality of forming rolls. To this end, a forming method may be used in which several conventional rolls are arranged. In addition to preheating of the steel strip, the resulting open pipe can also be wholly preheated. Preheating of the open pipe may be conducted with the same method and temperature as employed in preheating the steel strip.

Subsequently, the two opposed edges of the open pipe are exposed to preheating. Preferred here is an induction heating system provided with an induction heating coil.

By means of this preheating, the two edges of the open pipe are retained at a temperature of higher than about the Curie point, preferably lower than about 1,300° C.

Figure 10:
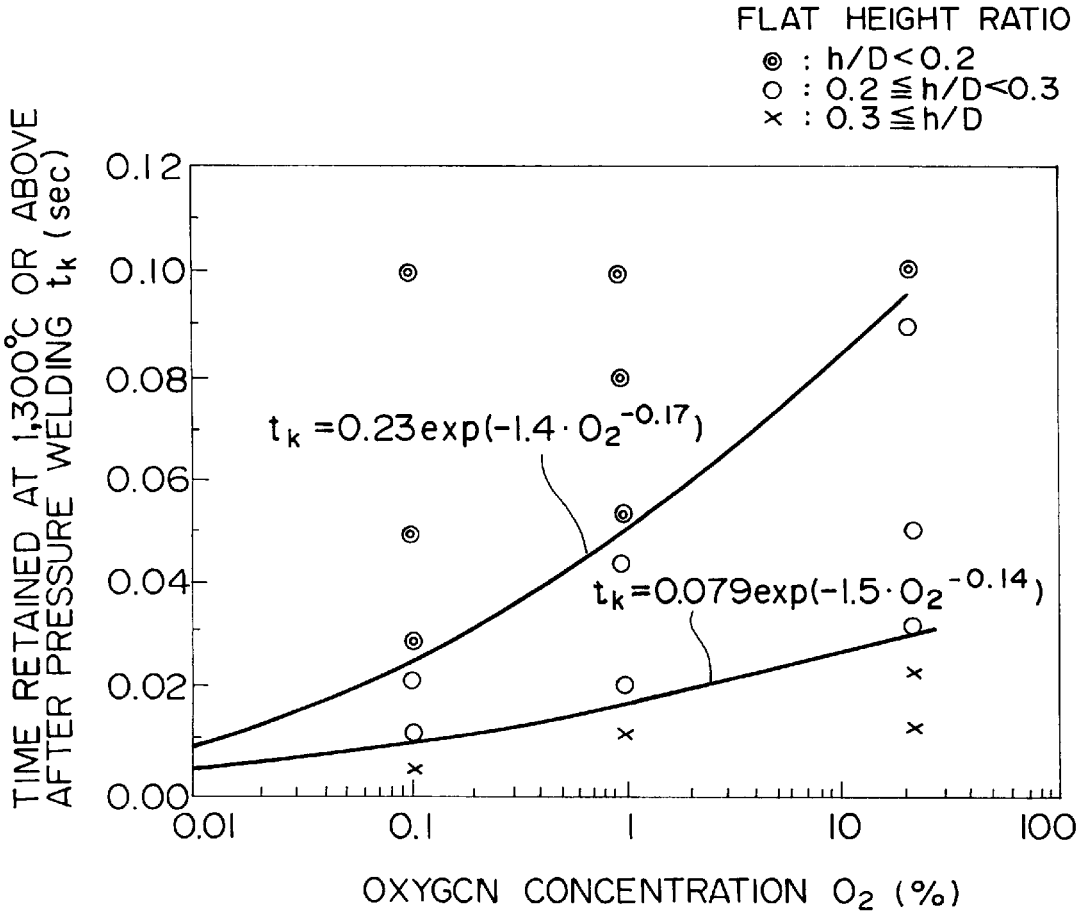
FIG. 10 is a graphical representation of the relationship between the time $t_k$ retaining the welded seam at about 1,300° C. or above, which time affects the seaming quality of the welded seam, and the concentration of oxygen in an ambient atmosphere.

Owing to the temperature dependence of specific permeability of a steel material as shown in FIG. 10, the steel material when heated at a temperature above the Curie point is transformed from a strongly magnetic material to a normally magnetic material with the consequence that the permeability (in terms of a vacuum ratio) becomes nearer to a numerical value of 1. On the other hand, the penetration depth S of induction current is expressed by equation (2):

$$S=\alpha(\rho/\mu_r f)^{1/2} \quad (2)$$

where S is the penetration depth (m), ρ is the resistivity (Ω·m), $\mu_r$ is the specific permeability, f is the frequency (kHz), and α is the constant.

Accordingly, upon heating of the two opposed edges of the open pipe at about the Curie point or above, the penetration depth S increases and the temperature distribution in each edge face to be pressure-welded is likely to become uniform. For these reasons, the two edges of the open pipe are allowed to be preheated in a temperature region of higher than about the Curie point. Temperatures higher than the Curie point but lower than about 1,300° C. are desirable from the viewpoint of heating energy efficiency. Though above 1,300° C. is applicable, a sudden rise in temperature at this stage causes the two edges of the open pipe to be susceptible only at their angular portions to a temperature higher than the melting point of the steel strip, thus inviting the formation of beads during welding. This in some cases hampers pipe production at a high speed. More desirably, therefore, preheating of the two opposite edges of the open pipe may be done at about 1,300° C. or below.

Figure 5:
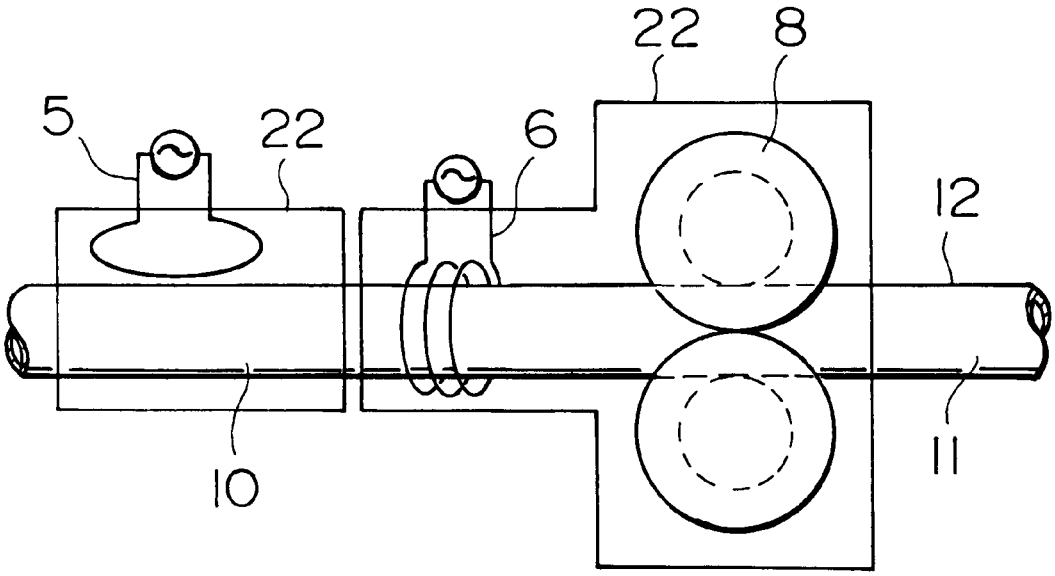
FIG. 5 is a schematic illustration, taken cross-sectionally, of a preheating unit for an open pipe, a heating unit for the open pipe, and a shield unit for shielding a squeeze roll for use in the apparatus of the invention.

Preheating of the two edges of the open pipe can be carried out in the atmosphere or an atmosphere less abundant in oxygen than the atmosphere (shielded atmosphere). With the weld seaming quality taken in view, the shielded atmosphere may be preferred. To provide the shielded atmosphere, it is preferred that a shielding unit 22 be located to entirely shield a preheater unit 5 for preheating the two opposite edges of the open pipe as illustrated in FIG. 5. Also desirably, edge preheating may be conducted in an atmosphere wherein the dew point is set at about −10° C. or below.

The two edges of the open pipe after being preheated as noted above are further heated in a solid-phase pressure-welding temperature region at a temperature higher than about 1,300° C. but lower than the melting point of the steel strip.

In consideration of energy efficiency, an induction heating system provided with an induction coil may be preferably used for heating the two edges of the open pipe.

The temperature used in heating the two edge faces of the open pipe can be controlled with the induction coil adjusted in regard to the output.

Heating at 1,300° C. or below can fail to sufficiently weld the edge faces of the open pipe, thus producing impaired seaming. Moreover, if the temperature at such edge faces exceeds the melting point of the steel strip, then a molten steel forms beads on inner and outer surfaces of the open pipe while in butt welding at the opposite edges of the latter. This requires inconvenient cutting of the beads. Thus, a solid-phase pressure-welding temperature region is chosen in which the temperatures are set to be higher than about 1,300° C. but lower than the melting point of the steel strip. More preferably, the temperatures are between about 1,350° C. and the melting point of the steel strip.

In heating the two opposed edges of the open pipe, a system using a laser beam, an electron beam or a plasma beam may also be suitably applicable.

The term "solid-phase pressure-welding" used herein denotes pressure welding in which beads are substantially prevented from getting bulged, and hence, little or no bead cutting is needed. To avoid bulged beads, the two opposed edges of the open pipe should preferably be in a solid phase. A solid-liquid phase may also be useful so long as its temperature is not higher than the melting point of the steel strip wherein a liquid phase is held in a limited amount.

In order to attain a uniform temperature distribution at the two edges of the open pipe, it is preferred that edge sagging is precisely adjusted on the steel strip, the background of the edge face is smooth, and the angle between the edge face and the strip surface is defined in a given range. Suitable preferred angles are in the range of about 60 to 120 degrees. Precise adjustment of sagging can be carried out prior to paying off of a coil, prior to formation of an open pipe subsequent to coil payoff, or after formation of the open pipe. Edge treatment may preferably be conducted with use of a steel strip-edging unit designed to enable cutting by an edge mirror, grinding by a grinding machine, or rolling by an edging roll.

Figure 4A:
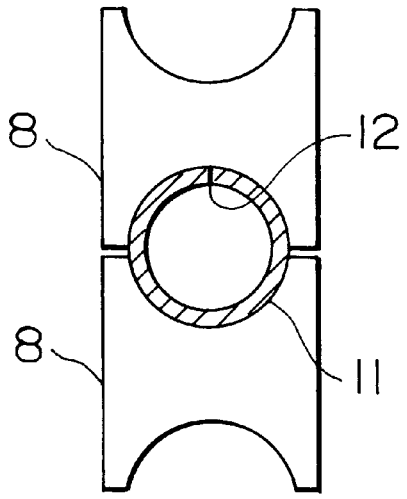
FIGS. 4A to 4C each are cross-sectional illustrations of the positional relationship between the squeeze roll during pressure welding at a solid phase and the outer surface of a pressure-welded seam.
Figure 4C:
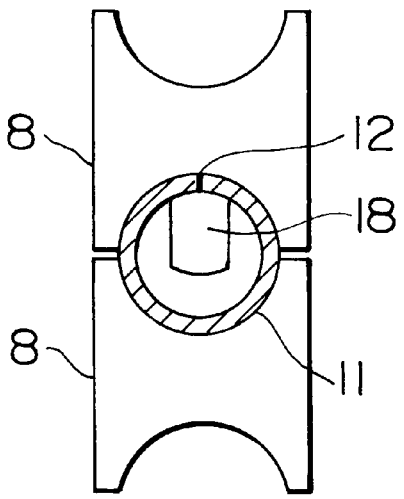
Figure 4B:
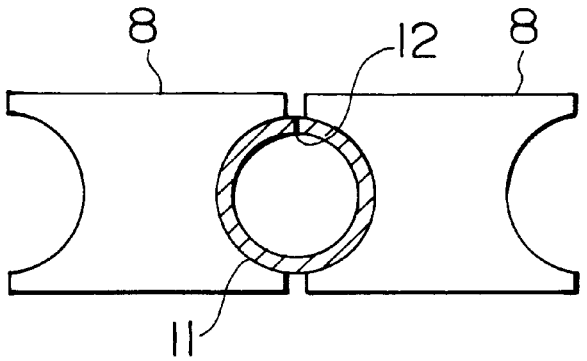

After being heated at the two opposite edges of the open pipe in a solid-phase pressure-welding temperature region as described above, the open pipe is butted at the two edges and solid-phase pressure-welded. For use in pressure welding, there may be a squeeze roll 8 located as to abut against an outer surface of the open pipe 11 at a pressure-welded seam 12 as illustrated in FIG. 4A, a squeeze roll 8 located so as not to abut against an outer surface of the pipe 11 at the pressure-welding portion 12 as seen in FIG. 4B, or the pipe 11 can be positioned to abut on its outer surface against the squeeze roller 8 and against a roll or the like at the pressure-welded seam 12. Either one of these preferred methods is suitably useful.

Edge heating and solid-phase pressure-welding can be carried out in either one of the atmosphere and an atmosphere less abundant in oxygen than the atmosphere (shielded atmosphere) as stated above in connection with edge preheating. With the weld seaming quality taken in view, the shielded atmosphere may be preferred. To provide the shielded atmosphere, it is preferred that a shielding unit 22 be located to entirely shield an edge-heating unit 6 and the squeeze roll 8 as shown in FIG. 5. Also in view of the weld seaming quality, edge heating and solid-phase pressure-welding may preferably be conducted in an atmosphere wherein the dew point is set at about −10° C. or below.

The present inventors have found that the weld seaming quality of a steel pipe is variable with a length of time $t_k$ at which the welded seam is retained at about 1,300° C. or above after pressure welding. The relationship between the retention time $t_k$ (sec) as affecting the weld seaming quality (flat height ratio h/D) and the concentration of oxygen (% by volume) is graphically represented in FIG. 10. As is clear from this graph, it has been found that the weld seaming quality is higher as the retention time $t_k$ at about 1,300° C. or above is longer. Another finding is that the retention time $t_k$ may be shortened to attain the weld seaming quality at the same level as the concentration of oxygen is reduced.

When edge preheating, edge heating and solid-phase pressure-welding are performed in the atmosphere, the retention time $t_k$ should preferably be longer than about 0.03 second. On the other hand, when edge preheating, edge heating and solid-phase pressure-welding are done in an atmosphere less abundant in oxygen than the atmosphere (shielded atmosphere), the retention time $t_k$ should preferably meet equation (1) given below:

$$t_k > a \cdot \exp\{-b \cdot [O_2]^c\} \quad (1)$$

where $O_2$ is the concentration (% by volume) of oxygen in an ambient atmosphere, and a, b and c are the constants. In the case of a low-carbon steel, a=0.079, b=1.5 and c=−0.14, more preferably a=0.23, b=1.4 and c=−0.17.

The retention time $t_k$ can be controlled by adjusting the speed of cooling of the welded seam after pressure welding. To this end, adjustments may preferably be made not only to the heating temperature and heating width higher than about the Curie point of two opposite edges of an open pipe during edge preheating, but also to the heating temperature of the two edge faces of the open pipe such that the temperature distribution during solid-phase pressure-welding can be controlled circumferentially of the open pipe from the edge faces to a central portion of the open pipe.

Figure 6A:
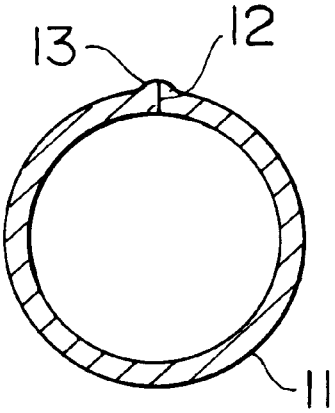
FIGS. 6A and 6B each are cross-sectional illustrations of an exemplary form of a steel pipe after being pressure-welded at its two opposite longitudinal edges and seen in cross section.
Figure 6B:
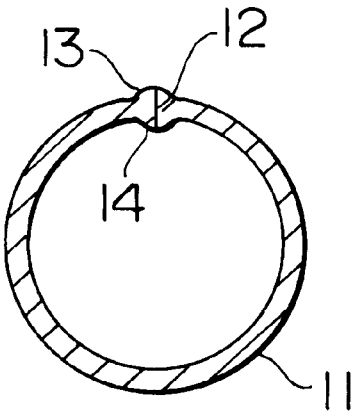
Figure 7A:
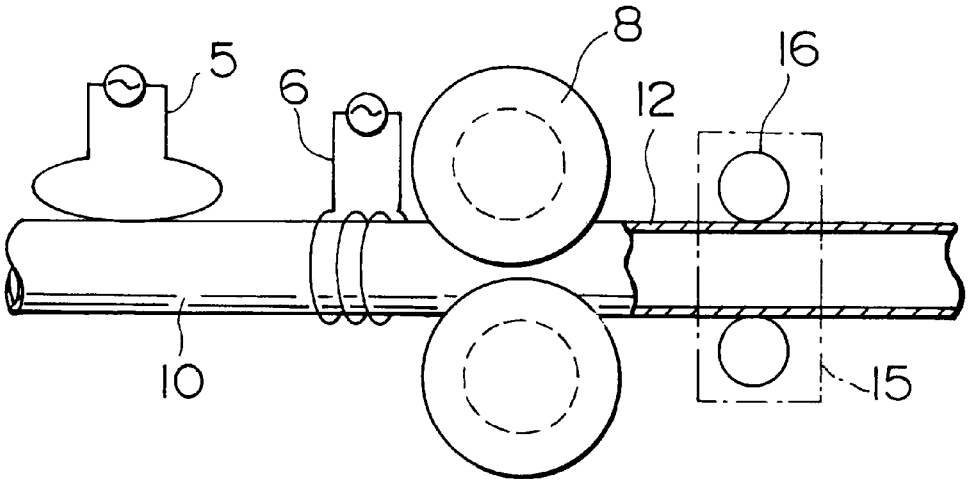
FIGS. 7A and 7B each are schematically partially side-elevational and cross-sectional illustrations of a rolling unit for rolling inner and outer surfaces of the welded seam for use in the invention.
Figure 7B:
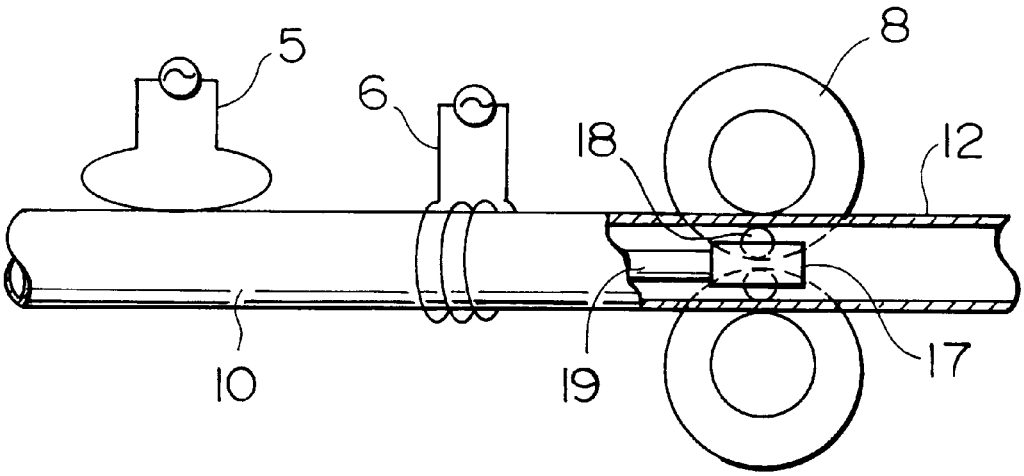

At the pressure-welded seam 12 induced from solid-phase pressure-welding, thick-walled portions 13, 14 are formed on inner and outer surfaces of the seam 12 as shown in FIGS. 6A and 6B. The portions 13, 14 arise from the extent of ultimate temperatures at the two edges, or of degrees of pressure welding with a squeeze roll. In consequence, the seam should be rolled adjacent to the thick-walled portions so as to reduce the thicknesses of the latter during pressure welding or at a suitable stage after pressure welding. In particular, the thickened portion 13 on the outer surface of the open pipe should be removed. This removal may be accomplished by outwardly rolling the pipe after pressure welding, for example, with use of a seam-rolling unit 15 provided with a seam-rolling roll 16 as illustrated in FIG. 7A. The thickened portion 14 on the inner surface of the pipe may be removed where desired, and this may be done by inwardly rolling the pipe using a seam-rolling unit 17 provided with a seam-rolling roll 18 and a rolling roll-supporting rod 19 as illustrated in FIG. 7B. The smoothing means 15, 17 for removal of the thick-walled portions 13, 14 include, without limitation to rolling using a roll, various plastic molding means, e.g., rolling using a machine tool such as a shoe or the like, and forging using a suitable machine tool.

Figure 8:
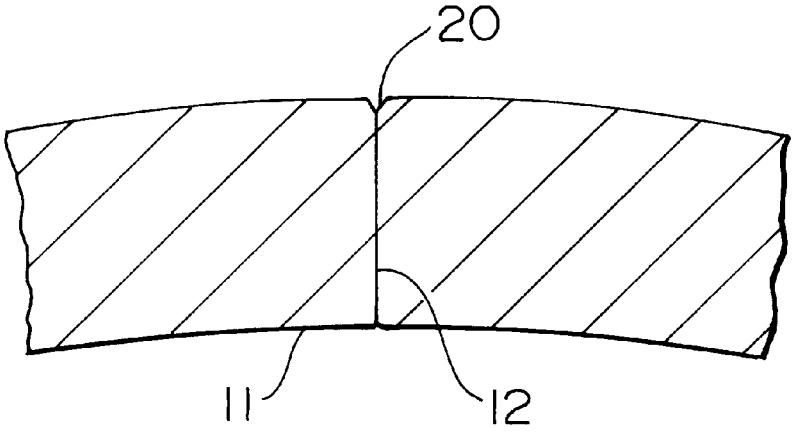
FIG. 8 is a schematic illustration, taken cross-sectionally, of an exemplary outer shape of the welded seam after being solid-phase pressure-welded.
Figure 9:
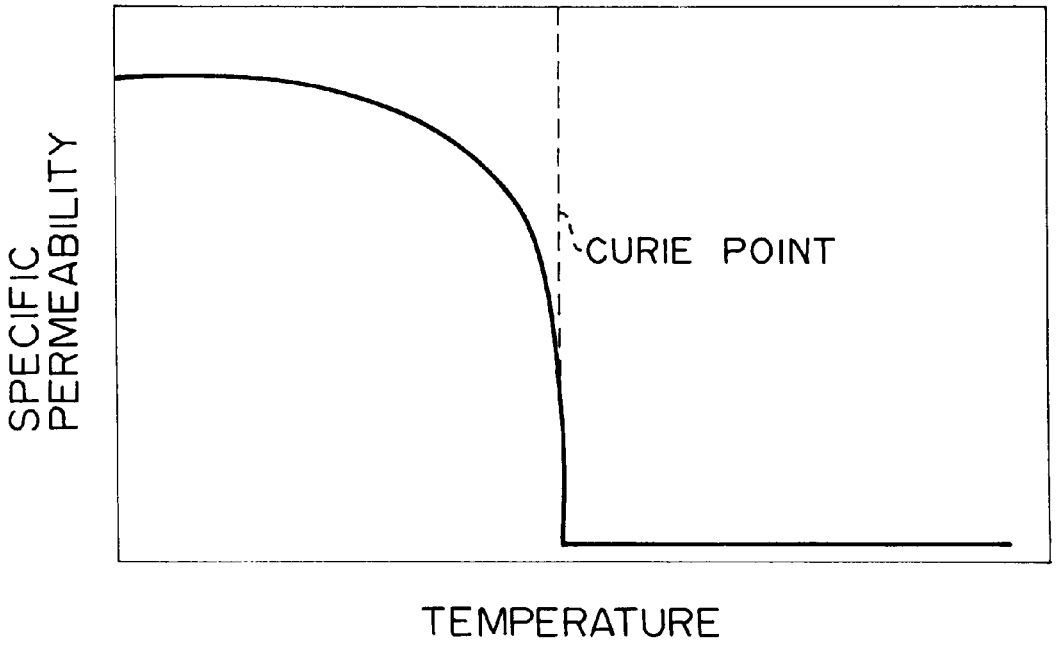
FIG. 9 is a characteristic curve showing the dependence of specific permeability on temperatures.

At the pressure-welded seam 12 provided from solid-phase pressure-welding, a fine recess-shaped portion sometimes appears on an outer surface of the seam 12 of the pipe 11 as shown in FIG. 8. This portion, commonly called a weld line 20, has a depth of about 0.2 mm and results from the extent of edge sagging of a steel strip, the precision of the edge adjustment, the method of pressure welding or the extent of increased thickness owing to pressure welding, irrespective of the presence or absence of smoothing of the welded seam using the seam-smoothing means 15, 17. The weld line 20 adversely affects the aesthetic pipe appearance and weld seaming quality of the resulting steel pipe. For this reason, the weld line 20 should preferably be removed, followed by smoothing of the portion devoid thereof. This removal may be conducted by means of a weld line-removing unit provided with a cutter, a grinder or the like, and can be conducted before or after rolling when the thick-walled portion on an outer surface of the pipe is rolled.

The steel pipe product thus obtained is cut to length with a cutter and then corrected with a pipe-correcting unit, or after the correction, is wound into coiled form.

In accordance with the present invention, the steel pipe can be stretch reduce-rolled to have an outer diameter as desired with reliance upon process steps described later.

In order to ensure dimensional accuracy of a steel pipe product after stretch reduce rolling, uniform-temperature treatment is made by cooling, heating or the like after solid-phase pressure-welding but before stretch reduce rolling of the steel pipe such that the latter has a circumferential temperature difference of lower than about 200° C.

Figure 12:
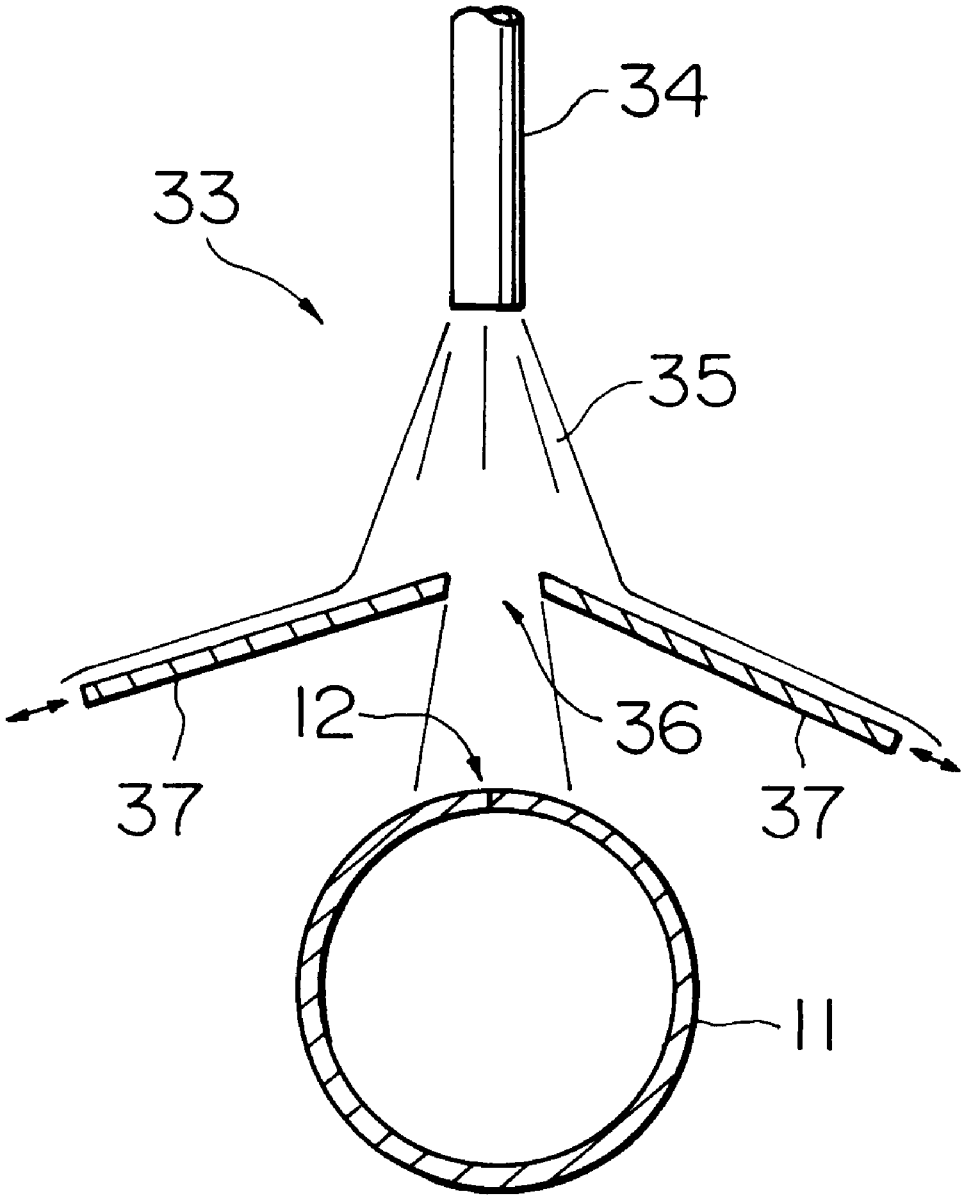
FIG. 12 is a schematically partially front-elevational and cross-sectional illustration of a cooler unit for cooling the welded seam of the steel pipe for use in the invention.

Firstly, the steel pipe obtained from solid-phase pressure-welding undergoes removal of a thick-walled portion on an outer surface of the welded seam and, where needed, further removal of a thick-walled portion on an inner surface of the welded seam and of a weld line. The welded seam is then subjected to forced cooling. This is done to make uniform the temperature distribution of the steel pipe on its circumference so that irregular sections can be avoided during stretch reduce rolling at a subsequent stage. The welded seam of the steel pipe is cooled by means of a mist 35 jetted from a nozzle 34 of a cooling unit 33 as shown in FIG. 12.

Secondly, the steel pipe is heated to a temperature sufficient to enable stretch reduce rolling and is then allowed to retain a uniform temperature using a steel pipe-heating unit. Thereafter, scale removal may preferably be performed, when desired.

The steel pipe after being heated to a predetermined temperature is stretch reduce-rolled at a given outer diameter by use of a stretch reduce-rolling unit provided with a plurality of stretch reduce-rolling mills, whereby a steel pipe product is obtained. Stretch reduce-rolling can be conducted at from about 125 to 725° C. Lower temperatures than 125° C. can cause reduced deformability of the material to be stretch reduce-rolled and hence can cause increased load for stretch reduce rolling with the consequence that the resulting steel pipe has seizing scars on its surface produced upon contact with the roll. Conversely, temperatures higher than about 725° C. can lead to increased surface roughness due to got-in scale tending to take place during rolling, resulting in a marred surface texture. Thus, the rolling temperatures should be in the range of about 125 to 725° C.

The rolling temperatures in the above-noted range may be selected depending upon ambient conditions. To be more specific, rolling temperatures of about 125 to 375° C. are preferable for reduced rolling load and improved resistance to seizing on contact with a roll. Rolling temperatures of about 375 to 725° C. may be chosen when mechanical properties and surface texture should be protected against deterioration by stretch reduce rolling.

The steel pipe product thus obtained is cut to length with a cutter and then corrected with a pipe-correcting unit, or after the correction, is wound into coiled form.

An apparatus for use in the practice of the method according to the present invention will now be described with reference to the drawings and, in particular, to FIGS. 1 to 3.

Figure 1:
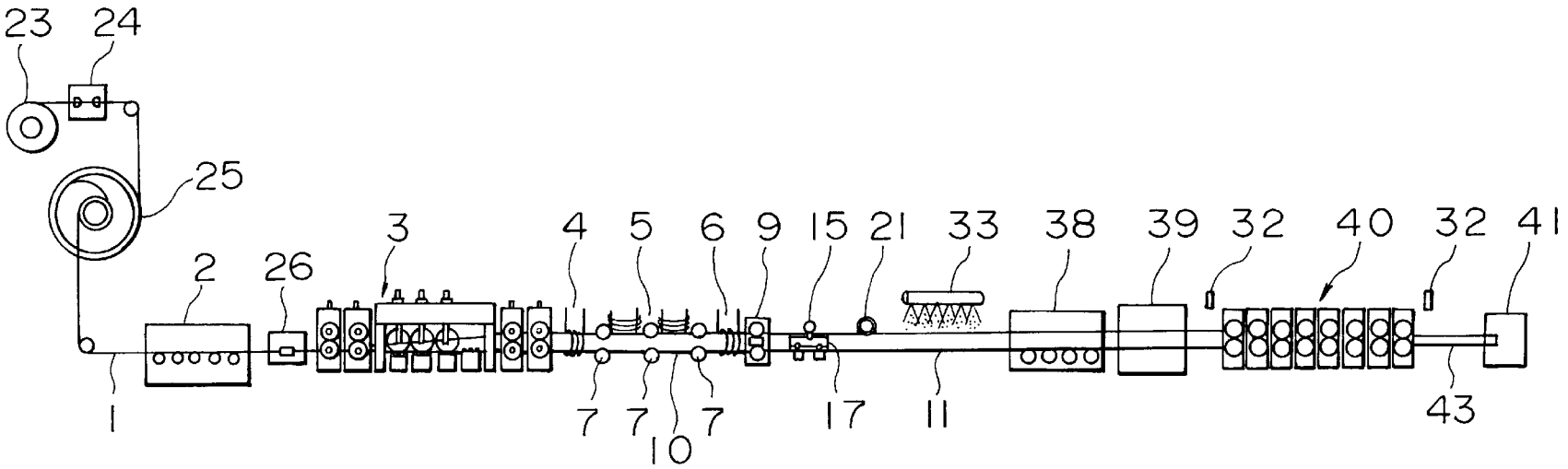
FIG. 1 is a side-elevational illustration of one embodiment of an apparatus for the practice of the present invention.

In FIG. 1, a steel strip is designated by 1, an uncoiler by 23, a connecting unit by 24, a looper by 25, a steel strip-preheating unit by 2, and a steel strip edge-treating unit by 26, respectively, in side elevation.

The uncoiler 23 is intended to pay off and supply the steel strip 1 in coiled form and includes a mandrel, a guide and other component parts.

The connecting unit 24 serves to continuously feed into a production line the steel strip 1 and weld-connects a rear end of a preceding steel strip having already been taken out and a front end of an ensuing steel strip while being paid off. A suitable form of this unit is a flash butt-welding machine comprised of an electrode, a damper and other parts.

The looper 25 stores the steel strip 1 in such an amount as needed for a continuous run without shutdown while the steel strip 1 is being connected using the connecting unit 24.

The steel strip-preheating unit 2 preheats the steel strip 1 in a hot-forming temperature region of lower than about 750° C. For example, a gas combustion type continuous heating furnace or an induction heater for use in steel strips may be suitably employed. The gas combustion type continuous heating furnace includes a furnace body, a burner, a hearth roll and other parts, whereas the induction heater includes a heating coil, an inductor and other parts. In the case where the thickness and travel speed of a steel plate are defined in a wide range, both the furnace and the heater may be preferably used together so that the temperature of the steel strip 1 is controlled with a greater level of precision.

The steel strip edge-treating unit 26 processes an edge portion of the steel strip 1 by means of rolling, cutting or other techniques, thereby adjusting the shape of each of two widthwise end faces of the steel strip. For example, an edger may be used which is provided with a vertical rolling roll, a stand for supporting the rolling roll, and other parts.

Turning again to FIG. 1, a forming unit is designated by 3, an open pipe-preheating unit by 4, an edge-preheating unit (edge heater) by 5, an edge-heating unit by 6, a squeeze stand by 9, a seam-smoothing unit by 15, a weld line-removing unit by 21 and a seam-guiding unit by 7, respectively, in side elevation.

The forming unit 3 acts to continuously mold the steel strip 1 into a cylindrical shape and to bring two widthwise end faces of the steel strip into opposed relation to each other, thereby forming an open pipe 10. This unit is provided with a plurality of forming stands and forming rolls and with other parts, A breakdown type or a cage forming type may be suitably used.

The open pipe-preheating unit 4 such as an induction heater preheats the open pipe 10 resulting from forming of the steel strip by the forming unit 3. In such case, the steel strip 1 may be preheated by the open pipe-preheating unit 4, instead of by the steel strip-preheating unit 2, or it may be preheated by both of the preheating units 2, 4.

Figure 11A:
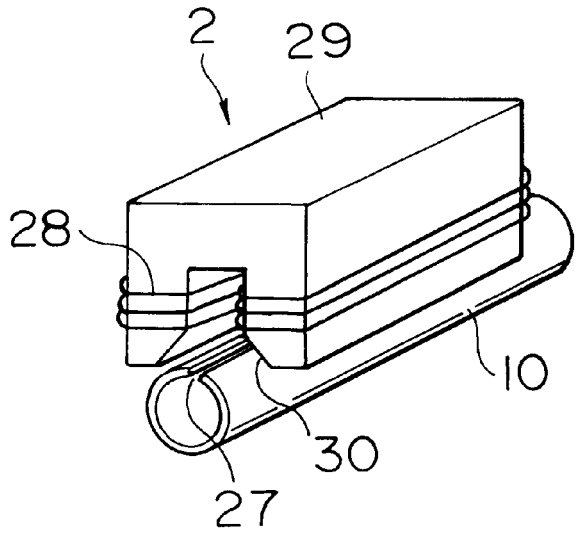
FIG. 11A is a perspective view of a preheating unit for preheating the open pipe at the two opposite edges for use in the invention.
Figure 11B:
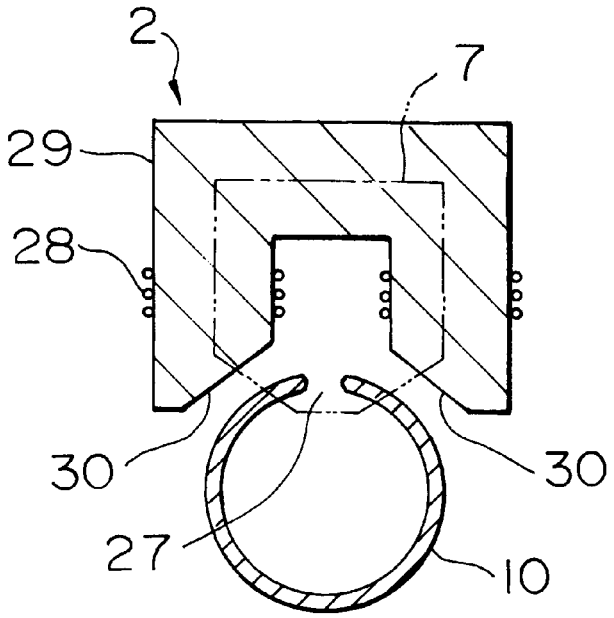
FIG. 11B is a front-elevational and cross-sectional view of the preheating unit of FIG. 11A.

The edge-preheating unit 5 heats the open pipe 10 at its edges by means of induction heating. This unit includes an electric source board, a matching board, a heating coil, an inductor and the like. In order to accomplish simple temperature control to meet various thicknesses of steel strip and various speeds for production of steel pipes, the coil and inductor should be arranged preferably with a plurality of stacks directed to the production line. An exemplary form of this arrangement is seen in FIGS. 11A and 11B, FIG. 11A being a perspective view of the edge-preheating unit 2 and FIG. 11B being a cross-sectional view of the unit 2 of FIG. 11A.

The edge-preheating unit 2 is provided at its bifurcated lower portions with magnetic poles 30, each having an induction coil 28 wound therearound. The open pipe 10 is allowed to pass between the magnetic poles 30 with a longitudinal slit 27 of the former held in confronted relation to the latter.

Referring again to FIG. 1, the seam-guiding unit 7 maintains constant the heights of the two edges of the open pipe 10 and the width of the slit between those edges so as to enable preheating and heating of the latter in stable manner. This unit includes a roll located to support the open pipe 10 and a stand disposed for supporting that roll, among other components.

The edge-heating unit 6 heats the open pipe 10 at its two edges in a solid-phase pressure-weld temperature region of higher than about 1,300° C. but lower than the melting point of the steel strip. This unit is provided with an electric source board, a matching board, a current transformer, a heating coil and other parts.

The two opposite edges of the open pipe 10 to be preheated and then heated by the edge-preheating unit 5 and then by the edge-heating unit 6 may preferably be maintained in a shielded atmosphere (non-oxidizable atmosphere) in a shielding unit 22 as illustrated in FIG. 5. The shielding unit 22 includes a sealing box for covering the two edges of the open pipe, a conduit for blowing an inert gas into the sealing box, and other constituent parts.

The squeeze stand 9 comprises a squeeze roll 8 and a housing for supporting the roll 8 and causes the two edges of the open pipe 10 to butt with each other and to become welded upon compression. Here, the edges have been heated to a solid-phase pressure-weld temperature region.

The seam-smoothing unit 15 smoothes, by means of rolling, a thick-walled portion that may have formed adjacent to the pressure-welded seam during rolling (see FIGS. 7A and 7B). This unit includes a roll holder, a rolling roll, a support roll and other parts.

The weld line-removing unit 21 removes, by means of rolling or cutting, any weld line 20 formed during rolling (see FIG. 8). This unit is provided with a grinding wheel or a cutting tool. Since the load in such case is by far smaller than in the bead cutting of an electrically seamed steel pipe, higher speeds for production of steel pipes are feasible without inconvenience.

Also in FIG. 1, there are shown a seam-cooling unit at 33, a steel pipe-heating unit at 38, a scale-removing unit at 39, a stretch reduce-rolling unit at 40 and a cutter at 41, respectively, in side elevation.

The seam-cooling unit 33 cools the higher-temperature portion adjacent to the seamed joint, thereby making substantially uniform the temperature distribution of the pressure-welded steel pipe 11 on its circumference and hence avoiding irregular sections during stretch reducing at a later stage. An exemplary form is seen in FIG. 12 in which the seam-cooling unit 33 is illustrated as a front-elevational and cross-sectional view. Defined between a nozzle 34 and a joint 12 is a slit 36, and a gas-liquid mist 35 is jetted from the nozzle 34 via the slit 36 with adjustments made to the slit width and the slit-seam. Thus, the steel pipe 11 is cooled only at a portion in close proximity to the seam.

The steel pipe-heating unit 38 heats the steel pipe 11 up to a temperature sufficient for stretch reduce rolling and exposes the steel pipe to a uniform temperature. For example, a combustion type continuous heating furnace and/or an induction heater are suitably applicable. The combustion type continuous heating furnace includes a furnace body, a burner, a hearth roll and other parts, while the induction heater includes a heating coil and other parts. In the case where the thicknesses of and the speeds for production of steel strips are set in a wide range, both the furnace and the heater may be preferably used in combination so that the temperature of the steel pipe 11 is controlled with a higher level of precision.

The scale-removing unit 39 is preferably located at this stage as shown in FIG. 1 in order to remove scale formed on an outer surface of the steel pipe 11 prior to stretch reduce rolling so that a high-quality surface can be attained. For example, a high-pressure water jet descaler provided with a high-pressure water conduit, a header, a nozzle and other parts, or a brush roller type descaler may be used.

The stretch reduce rolling unit 40 continuously subjects an outer surface of a steel pipe 11 to pressurization (stretch reduce rolling) in an appropriate temperature region with use of a multi-stage stand, thereby producing a steel pipe product 43 with a desired outer diameter. This unit includes a plurality of stands (stretch reduce-rolling machines) arranged in tandem, each such stand being provided with a housing and a plurality of rolls (perforated rolling rolls) peripherally disposed therein. A 3-roll stretching reducer or a 2-roll seizer is preferred.

The cutting unit 41 cuts to length the steel pipe product 43, as it moves. For example, a rotary hot saw provided with circular saw blades may be used.

Instead of cutting the steel pipe product 43 by the cutting unit 41, this product may be wound in coiled form onto a drum.

Figure 2:
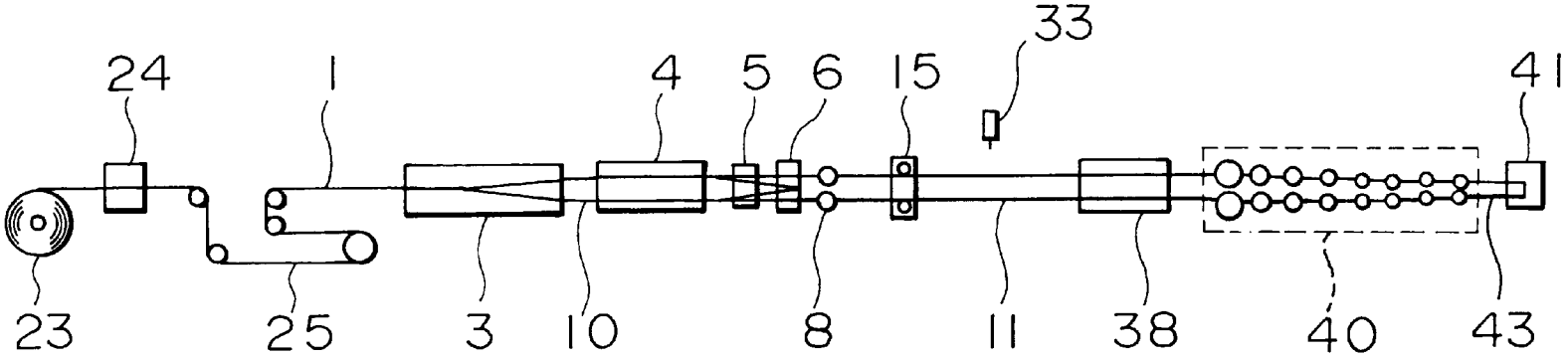
FIG. 2 is a view explanatory of another embodiment of the apparatus according to the invention.

FIG. 2 illustrates a second embodiment of the apparatus according to the present invention.

In such instance, an open pipe 10 undergoes preheating by use of an open pipe-preheating unit 4 as opposed to preheating of a steel strip 1 by use of a steel strip-preheating unit 2.

No further explanation will be required since other details of FIG. 2 are as described above in connection with the first embodiment of FIG. 1.

Figure 3:
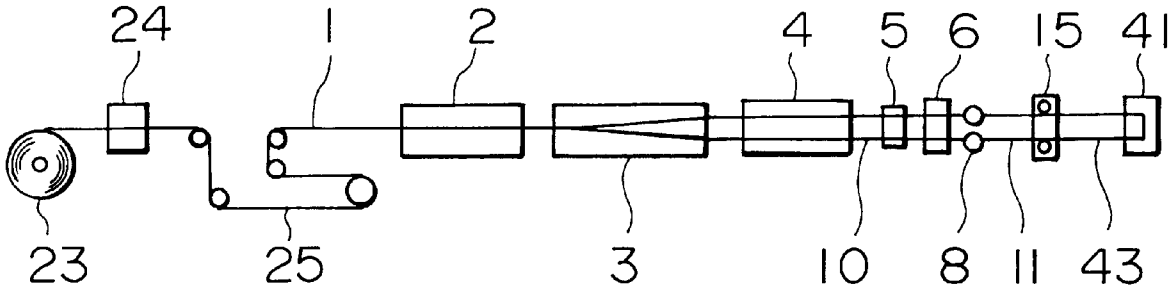
FIG. 3 is a view explanatory of a further embodiment of the apparatus according to the invention.

FIG. 3 illustrates a third embodiment of the apparatus according to the invention.

In such instance, a steel strip 1 is preheated by use of a steel strip-preheating unit 2. An open pipe 10 that is formed from the preheated steel strip 1 using a forming unit 3 is also preheated using an open pipe-preheating unit 4.

The open pipe 10 is pressure-welded at its two opposite edges by means of a squeeze roll stand 9, whereby a steel pipe 11 is obtained. After being smoothed at the seam by seam-smoothing means 15 so as to remove a thick-walled portion, the steel pipe 11 is cut to length using a cutting unit 41. This embodiment is devoid of a stretch reducing step as opposed to the embodiments of FIGS. 1 and 2.

The following examples are given to further illustrate the present invention.

Steel pipe products were produced using the apparatus shown in FIGS. 1, 2, 3, 5 and 7 and under the conditions indicated below.

A steel strip of 3.5 mm in thickness was continuously preheated at a temperature from about 400 to 650° C. using a steel strip-preheating unit 2, followed by continuous forming of the preheated steel strip with use of a forming unit 3, whereby an open pipe 10 was formed. Two opposite longitudinal edges of the open pipe were edge-preheated by an edge-preheating unit 5 and then heated by an edge-heating unit 6. Preheating and heating of the edges were based on a set of conditions shown in Table 1-1. The two opposed edges of the open pipe were solid-phase pressure-welded using a squeeze roll 8 disposed to abut against the edges of the open pipe. Subsequently, the pressure-welded seam was rolled inwardly and outwardly of the open pipe by use of seam-smoothing means 15, 17, whereby there was obtained a steel pipe 11 sized to be 137.0 mm (outer diameter)×3.5 mm (thickness).

The resulting steel pipe was exposed to the uniform temperature set forth in Table 1-2 by use of a steel pipe-heating unit 38, followed by stretch reducing of the steel pipe by use of a stretch reducing unit 40. Thus, a steel pipe product 43 was produced which was sized to be 60.5 mm (outer diameter)×3.5 mm (thickness). The rolling load during stretch reduce rolling was expressed as a ratio relative to the rolling load when stretch reduce rolling was conducted at normal temperature. The ratio is listed in Table 1-2. Examination was made of the steel pipe product 43 for weld seaming quality, surface roughness (Rmax) and seizing scars with the results also listed in Table 1-2. The seaming quality was judged from the flat height ratio of the steel pipe product 43 (h/D, h: flat height (mm), D: outer diameter (mm)). In regard to a few steel pipe products (Test No. 11 and Test No. 12), edge preheating, edge heating and solid-phase pressure-welding were carried out in a shielded atmosphere with use of a shielding unit 22 as shown in FIG. 5. As regards the steel pipe product of Test No. 17, edge preheating, edge heating and solid-phase pressure-welding were carried out in an atmosphere of −20° C. in dew point in the shielding unit 22.

Next, a steel strip 1 was so formed that its two end faces were molten and then pressure-welded into an electrically seamed steel pipe. The resulting steel pipe was reduced at normal temperature, whereby a steel pipe product 43 of 60.5 mm in outer diameter was produced. This product was taken as a conventional example (Test No. 13). In addition, a steel strip 1 was heated at 1,300° C. and forge-welded at its two opposite ends, followed by reducing of the resultant steel pipe, whereby a steel pipe product 43 of 60.5 mm in outer diameter was produced. This product was taken as a conventional example (Test No. 14). These conventional examples were evaluated in the same manner as in the inventive and comparative examples.

Test No. 1, No. 2, No. 11 and No. 12 within the scope of the present invention were smaller than 0.3 in flat height ratio and were less than Rmax 10 $\mu$m in surface roughness and moreover were free of seizing scars. Despite its flat height ratio of smaller than 0.3 and its surface roughness of less than Rmax 10 $\mu$m, the electrically seamed steel pipe or conventional product of Test No. 13 revealed a high rolling load, hence a large number of seizing scars. The forge-welded steel pipe or conventional product of Test No. 14 led to a flat height ratio of 0.4 to 0.6 and a surface roughness of Rmax 30 to 40 $\mu$m which proved to be inferior to those of the present invention. Test No.3, No. 4 and No. 5 that had a short retention time $t_k$ at 1,300° C. or above invited increased flat height ratios. High steel strip-preheating temperatures or stretch reduce-rolling temperatures resulted in excessive surface roughness Rmax as is clear from Test No. 6 and No. 10. Molten edge faces caused beads which needed removal by cutting with the result that the speed for pipe production reduced to 100 m/min as is apparent from Test No. 7. Test No. 8 conducted edge preheating at above 1,300° C. and produced excellent weld seaming and surface texture qualities with no decline in pipe production speed. Test No. 9 used a lower rolling temperature resulting in an increased rolling load and hence increased seizing scars.

The productivity attained by the present invention is as high as 60 tons/hr or higher, which is significantly greater than the 15 tons/hr level obtained with a conventional type of electrically seamed steel pipe with bead cutting.

Two opposite edges of an open pipe were treated, prior to forming, to have a right angle in Test No. 15 and No. 16 so that the finished steel pipes were smaller in flat height ratio than those of Test No. 1 and No. 2 in which edge treatment was omitted.

In Test No. 17, edge preheating, edge heating and solid-phase pressure-welding were conducted in an atmosphere wherein the dew point had been set at −20° C. with the result that a smaller flat height ratio was obtained than in Test No. 12 which was devoid of edge treatment.

According to the present invention, two opposite longitudinal edges of an open pipe can be stably retained in such a temperature region as to enable solid-phase pressure-welding so that a steel pipe is provided with enhanced weld seaming and surface texture qualities and with improved productivity. Advantageously, a wide variety of small product lots are acceptable.

In particular, the method of the invention produces a steel pipe product having high resistance to seam corrosion and cracking.

TABLE 1-1

| | | Edge preheating | | Edge heating and solid phase pressure welding | | | | |
|---|---|---|---|---|---|---|---|---|
| Test no. | Pre-heating temp. of steel strip (°C.) | End face temp. (°C.) | Oxygen concen-tration in ambient atmosphere (vol. %) | End face temp. (°C.) | Oxygen concen-tration in ambient atmosphere (vol. %) | Time retained at 1,300° C. or above (sec) | Value of equation (1) (sec) | Remark |
| 1 | 600 | 1000 | Atmospheric | 1400 | Atmospheric | 0.06 | 0.03 | Inventive ex. |
| 2 | 600 | 1100 | Atmospheric | 1450 | Atmospheric | 0.15 | 0.03 | Inventive ex. |
| 3 | 600 | 1000 | Atmospheric | 1250 | Atmospheric | — | 0.03 | Comp. ex. |
| 4 | — | 1100 | Atmospheric | 1350 | Atmospheric | 0.02 | 0.03 | Comp. ex. |
| 5 | — | 700 | Atmospheric | 1400 | Atmospheric | 0.01 | 0.03 | Comp. ex. |
| 6 | 850 | 1100 | Atmospheric | 1350 | Atmospheric | 0.11 | 0.03 | Comp. ex. |
| 7 | 600 | 1000 | Atmospheric | 1550*1 | Atmospheric | — | 0.03 | Comp. ex. |
| 8 | 600 | 1350 | Atmospheric | 1450 | Atmospheric | 0.07 | 0.03 | Inventive ex. |
| 9 | 200 | 1100 | Atmospheric | 1450 | Atmospheric | 0.04 | 0.03 | Comp. ex. |
| 10 | 750 | 1000 | Atmospheric | 1400 | Atmospheric | 0.06 | 0.03 | Comp. ex. |
| 11 | 600 | 1100 | 0.1 | 1350 | 0.1 | 0.05 | 0.01 | Inventive ex. |
| 12 | 400 | 900 | 0.1 | 1350 | 0.1 | 0.02 | 0.01 | Inventive ex. |
| 13 | — | — | — | 1580*1 | Atmospheric | — | — | Conventional ex. |
| 14 | 1300 | — | — | — | — | — | — | Conventional ex. |
| 15 | 600 | 1000 | Atmospheric | 1350 | Atmospheric | 0.07 | 0.03 | Inventive ex. |
| 16 | 600 | 1000 | Atmospheric | 1400 | Atmospheric | 0.12 | 0.03 | Inventive ex. |
| 17 | 400 | 900 | 0.1*2 | 1350 | 0.1*2 | 0.02 | 0.01 | Inventive ex. |

*1Molten
*2Controlled as to dew point

TABLE 1-2

| Test no. | Outer diameter after pressure welding (mm) | Speed of pipe forma-tion by rolling (m/min) | Stretch reduce rolling temp.*3 (°C.) | Outer diameter of pipe product (mm) | Speed of pipe forma-tion (m/min) | Flat height ratio*4 (h/D) | Surface rough-ness (Rmax) (μm) | Load ratio of stretch reduce rolling*5 (%) | Number of seizures*6 (piece) | Remark |
|---|---|---|---|---|---|---|---|---|---|---|
| 1 | 137.0 | 150 | 500 | 60.5 | 340 | 0.25 | 5.2 | 78 | 0 | Inventive ex. |
| 2 | 137.0 | 150 | 600 | 60.5 | 340 | 0.18 | 4.7 | 74 | 0 | Inventive ex. |
| 3 | 137.0 | 150 | 400 | 60.5 | 340 | 0.98 | 5.8 | 90 | 0 | Comp. ex. |
| 4 | 137.0 | 150 | 150 | 60.5 | 340 | 0.95 | 4.5 | 85 | 0 | Comp. ex. |
| 5 | 137.0 | 150 | 130 | 60.5 | 340 | 0.96 | 4.3 | 88 | 0 | Comp. ex. |
| 6 | 137.0 | 150 | 700 | 60.5 | 340 | 0.20 | 26.0 | 55 | 0 | Comp. ex. |
| 7 | 137.0 | 100 | 600 | 60.5 | 226 | 0.15 | 5.8 | 72 | 0 | Comp. ex. |
| 8 | 137.0 | 150 | 650 | 60.5 | 340 | 0.18 | 4.0 | 70 | 0 | Inventive ex. |
| 9 | 137.0 | 150 | 100 | 60.5 | 340 | 0.26 | 2.4 | 110 | 9 | Comp. ex. |
| 10 | 137.0 | 150 | 800 | 60.5 | 340 | 0.14 | 18.0 | 35 | 0 | Comp. ex. |
| 11 | 137.0 | 150 | 550 | 60.5 | 340 | 0.12 | 5.0 | 75 | 0 | Inventive ex. |
| 12 | 137.0 | 150 | 350 | 60.5 | 340 | 0.22 | 4.0 | 85 | 0 | Inventive ex. |
| 13 | 137.0 | 100 | 20 | 60.5 | 226 | 0.12 | 1.5 | 100 | 15 | Conventional ex. |
| 14 | 137.0 | 150 | 1280 | 60.5 | 340 | 0.58 | 40.0 | 10 | 0 | Conventional ex. |
| 15 | 137.0 | 150 | 600 | 60.5 | 340 | 0.16 | 5.1 | 74 | 0 | Inventive ex. |

TABLE 1-2-continued

| Test no. | Outer diameter after pressure welding (mm) | Speed of pipe formation by rolling (m/min) | Stretch reduce rolling temp.*3 (°C.) | Outer diameter of pipe product (mm) | Speed of pipe formation (m/min) | Flat height ratio*4 (h/D) | Surface roughness (Rmax) (μm) | Load ratio of stretch reduce rolling*5 (%) | Number of seizures*6 (piece) | Remark |
|---|---|---|---|---|---|---|---|---|---|---|
| 16 | 137.0 | 150 | 600 | 60.5 | 340 | 0.12 | 4.5 | 76 | 0 | Inventive ex. |
| 17 | 137.0 | 150 | 350 | 60.5 | 340 | 0.15 | 4.3 | 84 | 0 | Inventive ex. |

*3Rolling temperature on inlet side
*4
h: Flat height
D: Outer diameter of pipe
*5As 100 when in rolling at normal temperature
*6Per 10 m of pipe product

What is claimed is:

1. A method of the production of steel pipe which comprises the steps of: providing a steel strip; forming a preheated open pipe from said steel strip at a temperature of about 750° C. or less;

preheating opposite longitudinal edges of said open pipe by heating at a temperature greater than about the Curie point;

heating said opposite longitudinal edges of said open pipe by heating at a temperature greater than about 1,300° C. but lower than the melting point of said steel strip, and pressure-welding said open pipe using a squeeze roll to thereby form a steel pipe;

smoothing said steel pipe at a thick-walled portion on an outer surface of a welded seam formed between said opposite longitudinal edges; and subsequently cutting or coiling said steel pipe.

2. The method defined in claim 1, wherein said forming step comprises preheating said steel strip and subsequently forming said steel strip into said preheated open pipe using a molding roll.

3. The method defined in claim 1, wherein said forming step comprises forming said steel strip into an open pipe using a forming roll and subsequently preheating said open pipe in its entirety.

4. The method defined in claim 1, wherein said forming step comprises preheating said steel strip, forming said steel strip into an open pipe using a forming roll, and subsequently preheating said open pipe in its entirety.

5. The method defined in claim 1, wherein said steel strip or said open pipe is preheated at a temperature of about 200 to 750° C.

6. The method defined in claim 1, wherein said opposite longitudinal edges are preheated at a temperature greater than about the Curie point but lower than about 1,300° C.

7. The method defined in claim 1, wherein said open pipe is preheated and said opposite longitudinal edges are heated by means of induction heating at a frequency of about 0.5 to 100 kHz.

8. The method defined in claim 1, wherein said opposite longitudinal edges are preheated in an atmosphere having a reduced concentration of oxygen.

9. The method defined in claim 8, wherein said open pipe is preheated, heated and pressure-welded in an atmosphere having a dew point lower than about −10° C.

10. The method defined in claim 1, wherein said open pipe is heated and pressure-welded in an atmosphere having a reduced concentration of oxygen.

11. The method defined in claim 10, wherein said open pipe is preheated, heated and pressure-welded in an atmosphere having a dew point lower than about −10° C.

12. The method defined in claim 1, wherein a length of time $t_k$ at which said weld seam is retained at a temperature higher than about 1,300° C. is set to be longer than about 0.03 second according to the following equation:

$$t_k \geqq a \cdot \exp[-b \cdot (O_2)^c]$$

where $O_2$ is the concentration of oxygen (% by volume), a is about 0.079, b is about 1.5, and c is about −0.14.

13. The method defined in claim 1, wherein said steel strip is smoothed at opposite edge faces and treated to have a given angle before or after forming with said forming roll.

14. The method defined in claim 1, wherein, during or after said pressure welding, said welded seam is smoothed on its inner surface to remove a thick-walled portion formed thereon.

15. The method defined in claim 1, wherein said opposite longitudinal edges are heated using a member selected from the group consisting of a laser beam, an electron beam and a plasma beam.

16. A method of the production of steel pipe which comprises the steps of:

(a) providing a steel strip;

(b) forming a preheated open pipe from said steel strip;

(c) preheating opposite longitudinal edges of said open pipe by heating at a temperature greater than about the Curie point;

(d) heating said opposite longitudinal edges of said open pipe by heating at a temperature greater than about 1,300° C. but lower than the melting point of said steel strip, and pressure welding said open pipe using a squeeze roll to thereby form a steel pipe;

(e) smoothing said steel pipe at a thick-walled portion on an outer surface of a welded seam formed between said opposite longitudinal edges;

(f) cooling said steel pipe at said welded seam;

(g) treating said steel pipe at a substantially uniform temperature;

(h) stretch reduce-rolling said steel pipe at a temperature of about 125 to 725° C.; and (i) subsequently cutting or coiling said steel pipe.

17. The method defined in claim 16, wherein said forming step comprises preheating said steel strip and substantially forming said steel strip into said preheated open pipe using a forming roll.

18. The method defined in claim 16, wherein said forming step comprises forming said steel strip into an open pipe using a forming roll and subsequently preheating said open pipe in its entirety.

19. The method defined in claim 16, wherein said forming step comprises preheating said steel strip, forming said steel strip into an open pipe using a forming roll, and subsequently preheating said open pipe in its entirety.

20. The method defined in claim 16, wherein said steel strip or said open pipe is preheated at a temperature of about 200 to 750° C.

21. The method defined in claim 16, wherein said opposite longitudinal edges are preheated at a temperature greater than about the Curie point but lower than about 1,300° C.

22. The method defined in claim 16, wherein said open pipe is preheated and said opposite longitudinal edges are heated by means of induction heating at a frequency of about 0.5 to 100 kHz.

23. The method defined in claim 16, wherein said opposite longitudinal edges are preheated in an atmosphere having a reduced concentration of oxygen.

24. The method defined in claim 23, wherein said open pipe is preheated, heated and pressure-welded in an atmosphere having a dew point lower than about −10° C.

25. The method defined in claim 16, wherein said open pipe is heated and pressure-welded in an atmosphere having a reduced concentration of oxygen.

26. The method defined in claim 25, wherein said open pipe is preheated, heated and pressure-welded in an atmosphere having a dew point lower than about −10° C.

27. The method defined in claim 16, wherein a length of time $t_k$ at which said welded seam is retained at a temperature higher than about 1,300° C. is set to be longer than about 0.03 second according to the following equation:

$$t_k \geqq a \cdot \exp[-b \cdot (O_2)^c]$$

where $O_2$ is the concentration of oxygen (% by volume), a is about 0.079, b is about 1.5, and c is about −0.14.

28. The method defined in claim 16, wherein said steel strip is smoothed at opposite edge faces and treated to have a given angle before or after forming with said forming roll.

29. The method defined in claim 16, wherein, during or after said pressure welding, said welded seam is smoothed on its inner surface to remove a thick-walled portion formed thereon.

30. The method defined in claim 16, wherein said opposite longitudinal edges are heated using a member selected from the group consisting of a laser beam, an electron beam and a plasma beam.

31. An apparatus for the production of steel pipe which comprises:

a molding assembly comprising an uncoiler for delivering a steel strip, a preheater for preheating said steel strip or an open pipe formed therefrom to a temperature of about 750° C. or less, and a forming roll for forming said steel strip to form said open pipe;

an edge preheater comprising an induction coil arranged to preheat said open pipe at opposite longitudinal edges thereof to a temperature greater than about the Curie point;

an edge heater comprising an induction coil arranged to heat said open pipe at said opposite longitudinal edges;

a squeeze roll for pressure welding said open pipe to form a welded seam between said opposite longitudinal edges to thereby form a steel pipe;

means for smoothing a thick-walled portion formed on an outer surface of said welded seam; and an assembly for cutting or winding said steel pipe.

32. The apparatus defined in claim 31, wherein an edge-treating unit is disposed on an inlet or outlet side of said forming assembly for treating said steel strip at opposite end faces thereof.

33. The apparatus defined in claim 31, wherein said edge preheater, said edge heater, or said squeeze roll is provided with a shielding unit, the atmosphere of which is adjustable.

34. The apparatus defined in claim 31, further comprising a seam-smoothing unit comprising a roll disposed for smoothing a thick-walled portion formed on an inner surface of said welded seam.

35. An apparatus for the production of steel pipe which comprises:

a forming assembly comprising an uncoiler for delivering a steel strip, a preheater for preheating said steel strip or an open pipe formed therefrom, and a forming roll for forming said steel strip to form said open pipe;

an edge preheater comprising an induction coil arranged to preheat said open pipe at opposite longitudinal edges thereof;

an edge heater comprising an induction coil arranged to heat said open pipe at said opposite longitudinal edges;

a squeeze roll for pressure welding said open pipe to form a welded seam between said opposite longitudinal edges to thereby form a steel pipe;

means for smoothing a thick-walled portion formed on an outer surface of said welded seam;

a cooler unit positioned for forcedly cooling said steel pipe at said welded seam;

a heater positioned for heating said steel pipe to a uniform temperature;

a stretch reduce unit comprising a plurality of rolling mills adapted to draw-roll said steel pipe in a heated condition; and a unit for cutting or winding said steel pipe.

36. The apparatus defined in claim 35, wherein an edge-treating unit is disposed on an inlet or outlet side of said forming assembly for treating said steel strip at opposite end faces thereof.

37. The apparatus defined in claim 35, wherein said edge preheater, said edge heater, or said squeeze roll is provided with a shielding unit, the atmosphere of which is adjustable.

38. The apparatus defined in claim 35, further comprising a seam-smoothing unit comprising a roll disposed for smoothing a thick-walled portion formed on an inner surface of said welded seam.

* * * * *